US010370933B2

(12) United States Patent
Hiorth

(10) Patent No.: US 10,370,933 B2
(45) Date of Patent: Aug. 6, 2019

(54) WELL TOOL DEVICE COMPRISING FORCE DISTRIBUTION DEVICE

(71) Applicant: Interwell Technology AS, Ranheim (NO)

(72) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 0 days.

(21) Appl. No.: 15/541,028

(22) PCT Filed: Feb. 5, 2016

(86) PCT No.: PCT/EP2016/052497
§ 371 (c)(1),
(2) Date: Jun. 30, 2017

(87) PCT Pub. No.: WO2016/124735
PCT Pub. Date: Aug. 11, 2016

(65) Prior Publication Data

US 2017/0370175 A1 Dec. 28, 2017

(30) Foreign Application Priority Data

Feb. 6, 2015 (NO) ..... 20150175

(51) Int. Cl.
*F16J 15/20* (2006.01)
*E21B 33/128* (2006.01)
(Continued)

(52) U.S. Cl.
CPC ..... *E21B 33/128* (2013.01); *E21B 33/12* (2013.01); *E21B 33/134* (2013.01)

(58) Field of Classification Search
CPC ..... E21B 33/128; E21B 33/12; E21B 33/134; F16J 15/02; F16J 15/06; F16J 15/061; F16J 15/162
See application file for complete search history.

(56) References Cited

U.S. PATENT DOCUMENTS 3,354,964 A 11/1967 Young
3,554,280 A * 1/1971 Tucker ..... E21B 33/1208 166/134

(Continued)

OTHER PUBLICATIONS

International Search Report issued in corresponding application No. PCT/EP2016/052497 dated May 24, 2016 (2 pages).

(Continued)

*Primary Examiner* — Gilbert Y Lee
(74) *Attorney, Agent, or Firm* — Osha Liang LLP

(57) ABSTRACT

A well tool device includes a mandrel device, a sealing element and upper and lower supporting devices. The well tool device may be configured between a run state, in which the sealing element is radially retracted, and a set state, in which the sealing element is radially expanded. The well tool device further includes a pressure distribution device for distributing the pressure on the sealing element in the set state via the upper and lower supporting devices. The pressure distribution device includes a sleeve device provided radially outside the mandrel device and radially inside the sealing element, where the sleeve device is axially displaceable in a sleeve compartment in relation to the mandrel device and the sealing element. The sleeve device includes an upper protrusion for applying a downwardly directed axial force to the upper supporting device when the sleeve device is in its lower position.

9 Claims, 7 Drawing Sheets

(51) Int. Cl.
*E21B 33/12* (2006.01)
*E21B 33/134* (2006.01)

(56) References Cited

U.S. PATENT DOCUMENTS 5,311,938 A 5/1994 Hendrickson et al.
5,586,601 A 12/1996 Pringle
5,941,306 A 8/1999 Quinn
6,203,020 B1 * 3/2001 Mireles, Jr. ..... E21B 33/1216 277/336
6,598,672 B2 * 7/2003 Bell ..... E21B 33/1216 166/118
6,769,491 B2 * 8/2004 Zimmerman ..... E21B 33/1204 166/138
8,167,033 B2 * 5/2012 White ..... E21B 33/128 166/134
8,205,671 B1 * 6/2012 Branton ..... E21B 33/134 166/118
8,393,400 B2 * 3/2013 Buckle ..... E21B 33/04 166/368
8,567,492 B2 * 10/2013 White ..... E21B 33/1216 166/134
2003/0132008 A1 7/2003 Hirth et al.
2009/0056956 A1 3/2009 Ingram
2012/0217025 A1 * 8/2012 Shkurti ..... E21B 33/1216 166/387
2018/0023366 A1 * 1/2018 Deng ..... E21B 33/1216 277/339

OTHER PUBLICATIONS

Written Opinion of the International Searching Authority issued in corresponding application No. PCT/EP2016/052497 dated May 24, 2016 (7 pages).
Norwegian Search Report issued in corresponding application No. 20150175 dated Sep. 2, 2015 (2 pages).

* cited by examiner

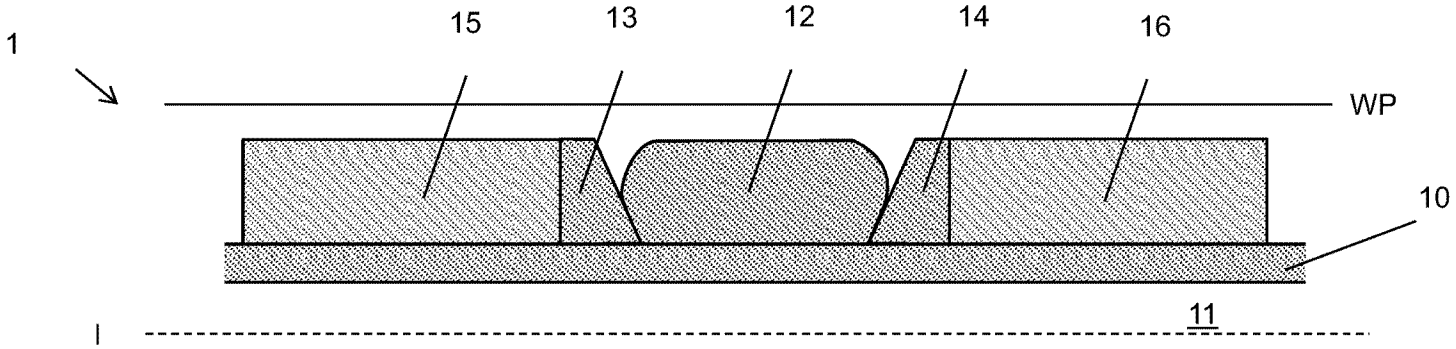
Fig. 1: Prior art
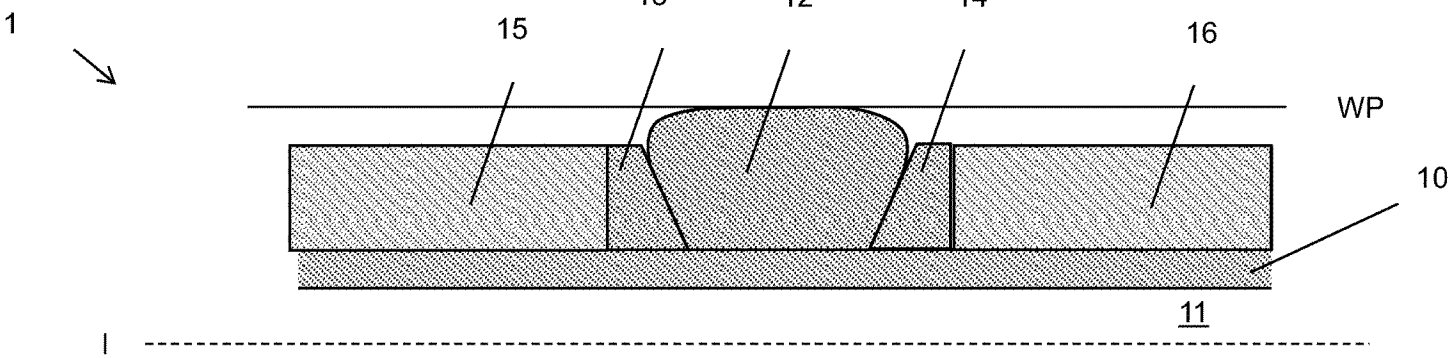
Fig. 2: Prior art

WELL TOOL DEVICE COMPRISING FORCE DISTRIBUTION DEVICE

FIELD OF THE INVENTION

The present invention relates to a well tool device comprising a force distribution device.

BACKGROUND

Well tool devices used in oil and/or gas wells, such as different types of plugging devices (bridge plugs, packers etc) typically comprises a sealing element provided circumferentially around a mandrel device. On each side (i.e. on the upper side and on the lower side) of the sealing element, supporting devices are provided. The well tool device may be configured to be in a run state (a radially retracted state) and a set state (a radially expanded state). The run state is used when running the well tool device into the well. In the set state, a relative axial movement between the supporting devices is causing the sealing element to be compressed axially and hence to expand radially until the outer surface of the sealing element is in contact with the inner surface of the well pipe. Hence, a seal is provided in the annular space between the inner surface of the well pipe and the mandrel device and fluid flow between the lower side of the seal and the upper side of the seal is prevented.

In the set state, the well tool device is designed to withstand a pressure difference between the lower side of the sealing element and the upper side of the sealing element.

The well tool device typically also comprises a ratchet mechanism in order to allow axial movement of at least one of the supporting device in one (a forward) direction (i.e. to move the sealing element from the run state to the set state) but to prevent movement of the at least one supporting device in the opposite (a reverse) direction (i.e. to prevent radial retraction of the sealing element).

There are some disadvantages with these prior art well tool devices.

First, if the well tool device is set in the well at a high temperature, a decrease in temperature may cause the sealing element to shrink. In such a situation, there is a risk that the sealing element may not withstand the same pressure difference as before the temperature decrease.

Second, when the well tool device has been set, the pressure below the sealing element will often increase to a pressure being higher than the pressure above the sealing element, since fluid flow is prevented by the sealing element. This pressure difference will apply a force to the well tool device which is contributing to a compression of the sealing element via the supporting devices. However, if the fluid pressure changes, for example if the pressure above the sealing element gets equal to, or higher than the pressure below the sealing element, there is a risk that the compression force applied by the supporting device onto the sealing element will be reduced.

Third, the ratchet mechanism will allow some movement also in the reverse direction, typically a length up to one teeth length. This reverse movement is often referred to as the "backlash" of the ratchet mechanism.

Hence, in these situations, there is a risk that the sealing element will not be in sufficient contact with the inner surface of the well pipe anymore. Consequently, the well tool device is no longer working as intended.

The above situations may occur in particular in injection wells, where the well tool is cooled down by the injected fluid and where the differential pressure over the sealing element will change before, during and after the injection operation, for example when a safety valve is maintained or tested, etc. Also well tools used in acidizing operations, fracking operations etc may be subjected to the abovementioned temperature/pressure conditions.

In prior art, these effects may be at least partially compensated for by means of relatively long springs (spiral springs or cup springs) applying an axial force onto the supporting devices towards the sealing element. The disadvantage with this solution is that it does not always work sufficiently. Moreover, this solution will increase the length of the well tool device considerably.

Moreover, as coiled springs only give a relatively small force, cup springs must be used in many such tools. The cup springs must often be hardened to achieve satisfying material properties, and if the well tool is to be NACE approved (National Association of Corrosion Engineers), only a few materials can be used, such as UNS N07750, UNS R30003, and UNS R30035. These materials are very expensive. For some applications, the well tool device will need a cup spring with a total length of 150-200 mm and will comprise ca 30 cups/discs.

SUMMARY OF INVENTION

One or more embodiments of the invention provide a well tool device where the above situations are addressed.

Moreover, many such well tool devices are relatively long, which contributes to a higher material cost and a higher manufacturing cost (machining, milling etc). Hence, one or more embodiments of the present invention reduce the length of such well tool devices. A reduction of length will also make the handling of the tools easier, and possibly also the transportation costs may be reduced.

One or more embodiments of the invention reduce the length of the cup spring and hence reduce the length and costs for the well tool device.

One or more embodiments of the present invention relate to a well tool device, comprising:

- a mandrel device;
- a sealing element provided radially outside the mandrel device;
- an upper supporting device provided outside of the mandrel device on the upper side of the sealing element;
- a lower supporting device provided outside of the mandrel device on the lower side of the sealing element;
- an upper housing device provided outside of the mandrel device on the upper side of the upper supporting device;
- a lower housing device provided outside of the mandrel device on the lower side of the lower supporting device;

where the well tool device may be configured between a run state, in which the sealing element is radially retracted, and a set state, in which the sealing element is radially expanded.

One or more embodiments of the invention may be characterized in that the well tool device further comprises a pressure distribution device for distributing the pressure on the sealing element in the set state via the upper and lower supporting devices, where the pressure distribution device comprises:

a sleeve device provided radially outside the mandrel device and radially inside the sealing element, where the sleeve device is axially displaceable in a sleeve compartment in relation to the mandrel device and the sealing element;

where the sleeve device comprises an upper protrusion for applying a downwardly directed axial force to the upper supporting device when the sleeve device is in its lower position;

where the sleeve device comprises a lower protrusion for applying an upwardly directed axial force to the lower supporting device when the sleeve device is in its upper position;

where a first sealing device is provided radially between the inner surface of the sleeve device and the outer surface of the mandrel device.

The purpose of the pressure distribution device is to distribute the pressure or force applied to the upper and/or lower supporting devices in an improved way and hence to avoid the above-mentioned disadvantages. This is achieved as defined in claim 1 by applying a downwardly directed axial force to the upper supporting device in some situations and by applying a downwardly directed axial force to the upper supporting device in other situations. Hence, the pressure distribution device may also be referred to as a pressure and/or force transmitting device.

In one aspect, the device comprises an upper spring device provided axially between the upper housing device and the upper supporting device.

In one aspect, the upper spring device is provided axially between the upper supporting device and the upper protrusion.

In one aspect, the upper housing device is connected to the upper supporting device by means of an upper connection device, where the upper connection device is configured to allow an axial displacement between the upper supporting device and the upper housing device.

In one aspect, the upper housing device comprises a downwardly protruding ring forming the sleeve compartment, where the downwardly protruding ring has an inner diameter larger than the outer diameter of the upper protrusion of the sleeve device.

In one aspect, the well tool device comprises a lower spring device provided axially between the lower housing device and the lower supporting device.

In one aspect, the lower spring device is provided axially between the lower supporting device and the lower protrusion.

In one aspect, the lower housing device is connected to the lower supporting device by means of a lower connection device, where the lower connection device is configured to allow an axial displacement between the lower supporting device and the lower housing device.

In one aspect, the lower housing device comprises a upwardly protruding ring forming the sleeve compartment, where the upwardly protruding ring has an inner diameter larger than the outer diameter of the lower protrusion of the sleeve device.

In one aspect, the upper and lower protrusions are protruding in a radial direction out from the sleeve device.

In one aspect, the second sealing device is provided radially between the upper supporting device and the sliding surface.

In one aspect, a third sealing device is provided radially between the lower supporting device and the sliding surface.

The above well tool may be a plugging device, a bridge plug, a packer, a straddle, a production packer etc.

DETAILED DESCRIPTION OF THE INVENTION

Embodiments of the invention will now be described with reference to the enclosed drawings, where FIG. 1 illustrates a cross sectional view of a prior art plugging device in its run state;

FIG. 2 illustrates a cross sectional view of the plugging device in FIG. 1 in its set state;

Figure 3:
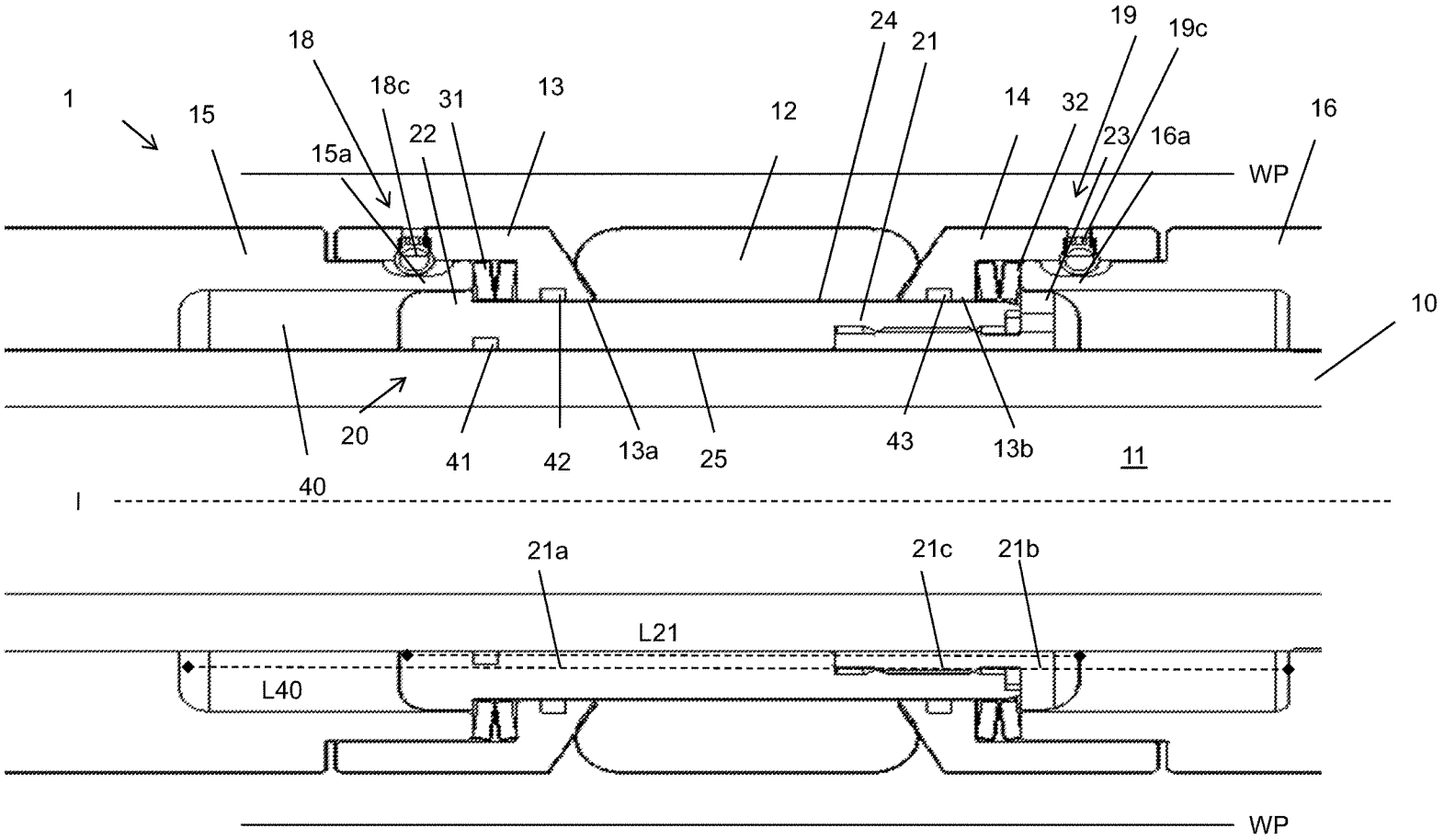
FIG. 3 illustrates a cross sectional view of one or more embodiments of the invention in its run state.

In the following description, the term "upper side" or similar is meant to describe the side of the drawings which are closest to the top side of the well, while the term "lower side" or similar is meant to describe the side of the drawings which are closest to the bottom of the well.

It is now referred to FIGS. 1 and 2, illustrating a prior art well tool device 1 being a part of a plugging device. It should be noted that only the upper half section of the well tool device 1 is shown in FIGS. 1 and 2, where a dashed line I indicates the center axis of device 1.

The well tool device 1 comprises a mandrel device 10 with a through bore 11. The mandrel device 10 is typically cylindrical.

The well tool device further comprises a sealing element 12 provided radially around the mandrel device 10, i.e. the sealing element 12 is provided circumferentially around the mandrel device 10. On the upper side (on the left side in FIGS. 1 and 2) an upper supporting device 13 is provided and on the lower side (on the right side in FIGS. 1 and 2) a lower supporting device 14 is provided. At least one of the supporting devices 13, 14 may be displaced axially in relation to the mandrel device 10 towards the sealing element 10, thereby causing axial compression and radial expansion of the sealing element 12. In FIG. 1 the supporting devices 13, 14 and the sealing element 12 are in their initial position, here the well tool device is in its run state. As shown, there is a clearance between the outer surface of the well tool device 1 and the well surface indicated by line WP. At the desired location is the well, the at least one supporting device 13, 14 is displaced axially towards the sealing element 12, causing it to go to its set state illustrated in FIG. 2. Here, the sealing element 12 is sealing both against the outer surface of the mandrel device 10 and against the inner surface of the well pipe WP. Consequently, fluid flow in the annular space outside of the mandrel device 10 between the upper side of the sealing element 10 and the lower side of the sealing element 10 is prevented.

In FIGS. 1 and 2, also housing devices 15 and 16 are indicated. The housing devices 15, 16 are provided radially outside the mandrel device 10 and may be used to actuate the supporting devices 13, 14 by means of the setting/retrieval tools. It should be noted that one of the housing devices may be fixed to the mandrel device. It is also possible that both of the housing devices are fixed to the mandrel device, in such case a further actuation element (not shown) provided inside or outside of one of the housing devices is used to actuate the supporting device(s) via the setting/retrieval tools.

It is now referred to FIG. 3. Here, it is shown that the well tool device 1 comprises a mandrel device 10 and a sealing element 12 provided radially outside the mandrel device 10. An upper supporting device 13 is provided outside of the mandrel device 10 on the upper side of the sealing element 12 and a lower supporting device 14 is provided outside of the mandrel device 10 on the lower side of the sealing element 12. In FIG. 3, the mandrel device 10 has a through bore 11.

Also in FIG. 3, the center axis I is indicated with a dashed line.

In FIG. 3, the well tool device 1 further comprises an upper housing device 15 provided outside of the mandrel device 10 on the upper side of the upper supporting device 13, and a lower housing device 16 provided outside of the mandrel device 10 on the lower side of the lower supporting device 14.

In one or more embodiments, the upper and lower supporting devices 13, 14 and the upper and lower housing devices 15, 16 are movable in an axial direction in relation to the mandrel device 10. However, in one or more alternative embodiments, one of the housing devices may be fixed to the mandrel device 10.

In FIG. 3, the run state is illustrated, where the sealing element 12 is radially retracted. As shown, there is a distance between the well tool device 1 and the inner surface of the well pipe, indicated by lines WP.

The well tool device 1 further comprises a pressure distribution device 20, for distributing the pressure on the sealing element 12 in the set state via the upper and lower supporting devices 13, 14. More specifically, the pressure distribution device 20 is distributing or transmitting the differential fluid pressure over the sealing element 12 in the set state via the upper and lower supporting devices 13, 14 further to the sealing element 12. The function of the pressure distribution device 20 will be described further in detail below.

Figure 4:
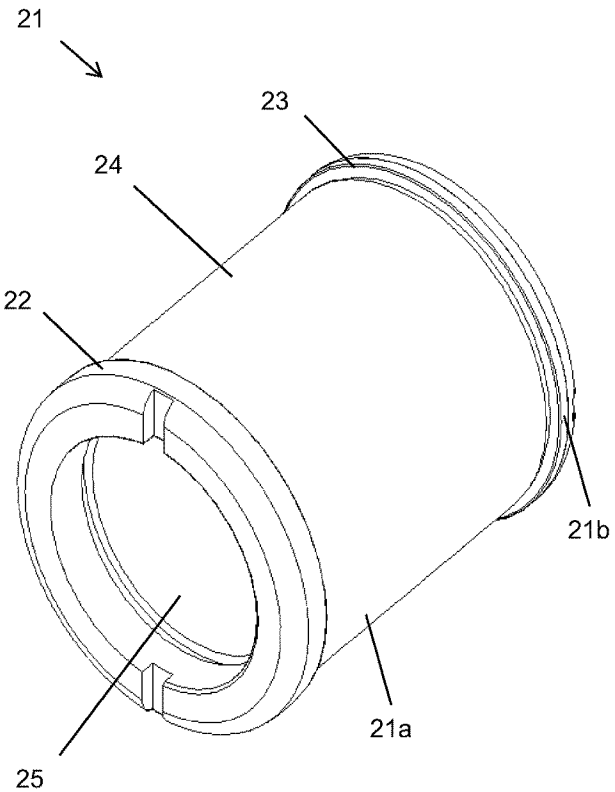
FIG. 4 illustrates a perspective view of the sleeve device.

In FIG. 3, it is shown that the pressure distribution device 20 comprises a sleeve device 21 provided radially outside the mandrel device 10 and radially inside the sealing element 12. The sleeve device 21 is shown in FIG. 4 and is substantially cylindrical. It has an outer surface 24 and an inner surface 25. The outer surface 24 is in contact with the sealing element 12, and the inner surface 25 is in contact with the outer surface of the mandrel device 10. Consequently, the sealing element 12 is not in contact with the mandrel device 10.

In the set state, the sealing element 12 is sealing towards the inner surface of the well pipe WP and is also sealing towards the sleeve device 21. A first sealing device 41 is provided radially between the inner surface 25 of the sleeve device 20 and the outer surface of the mandrel device 10, i.e. the first sealing device 41 is provided circumferentially outside the mandrel device 10 and circumferentially inside the sleeve device 21. The purpose of the first sealing device 41 is to prevent fluid flow between the mandrel device 10 and the sleeve device 21.

Figure 5:
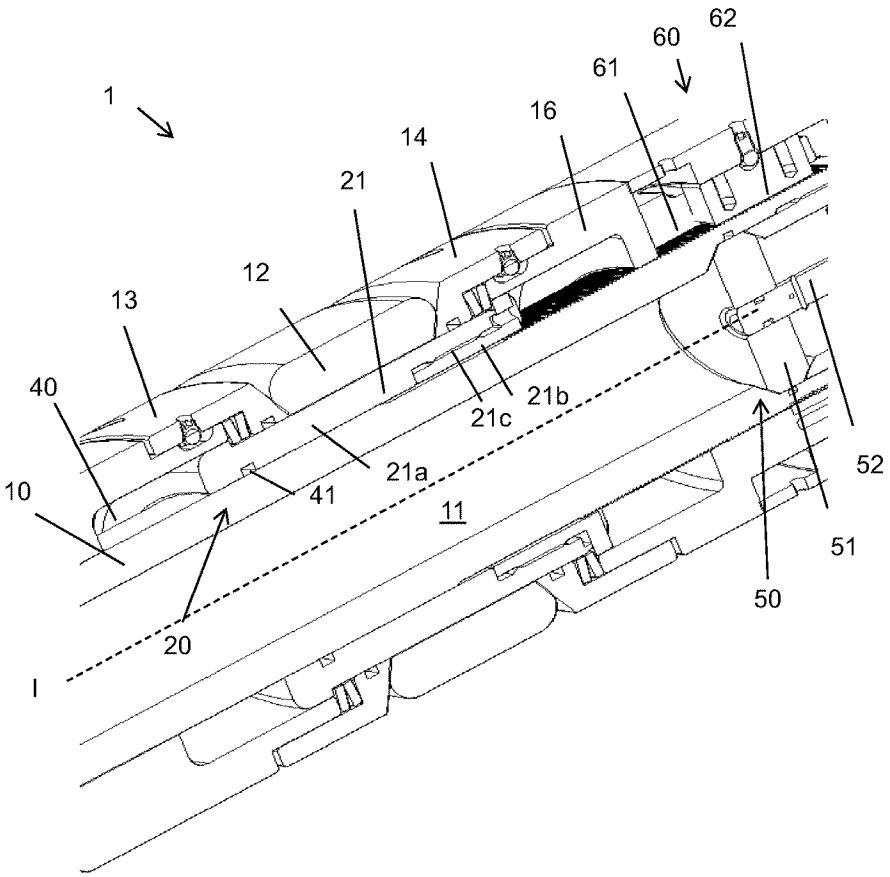
FIG. 5 illustrates a perspective cross sectional view of the one or more embodiments in the run state.

In FIGS. 3, 4 and 5, it is shown that the sleeve device 21 is made of two parts, a first sleeve section 21*a* and a second sleeve section 21*b* connected by means of a threaded connection interface indicated in FIG. 5 with reference number 21*c*. This will simplify the assembly of the well tool device 1.

The sleeve device 21 further comprises an upper protrusion 22 protruding in a radial direction out from the sleeve device 21 and a lower protrusion 23 protruding in a radial direction out from the sleeve device 21. The upper and lower protrusions 22, 23 may be provided as continuous flanges circumferentially outside the sleeve device 21, as indicated in FIG. 4. However, it is possible to provide the upper and lower protrusions 22, 23 as several spaced apart protrusions distributed around the circumference of the sleeve device 21.

The sleeve compartment 40 has a length L40 which is considerably longer than the length L21 of the sleeve device 21, as indicated in FIG. 3. In one or more embodiments, the length L40 of the sleeve compartment 40 in the run state more than twice the length L21 of the sleeve device 21. It should be noted that this will depend on the length of the sealing element in the run state and in the set state (i.e. the compression rate of the sealing element). The sleeve compartment 40 should be sufficiently long to allo movement of the sleeve device 21 in the set state, i.e. the movement of the sleeve device 21 should not be limited by the length of the sleeve compartment 21 in the set state.

The sleeve device 21 is axially displaceable in a sleeve compartment 40 in relation to the mandrel device 10 and the sealing element 12. It should be noted that the sealing element 12 and the first sealing device 41 will provide friction and hence at least some pressure must be applied to the sleeve device 21 in order to displace it axially in relation to the sealing element 12 and mandrel device 10.

In FIG. 3, it is shown that the upper and lower supporting devices 13, 14 each has a contact surface 13*a*, 14*a* respectively for contact with the outer surface 24 of the sleeve device 21. The upper and lower supporting devices 13 are axially displaceable in relation to the outer surface 24. However, the axial displacement of the upper supporting device is limited by the upper protrusion 22, and the axial displacement of the lower supporting device is limited by the lower protrusion 23, as these protrusions 22, 23 protrudes radially from the outer surface 24.

A second sealing device 42 may be provided radially between the upper supporting device 13 and the outer surface 24. A third sealing device 43 may be provided radially between the lower supporting device 14 and the sliding surface 23. The first, second and third sealing devices 41, 42, 43 may be O-rings or other types of sealing devices.

The upper housing device 15 comprises a downwardly protruding ring 15*a*, having an inner diameter larger than the outer diameter of the upper protrusion 22 of the sleeve device 21. Hence, the protruding ring 15*a* forms a "cup", where the space inside the cup forms the upper part of the sleeve compartment 40.

Figure 11:
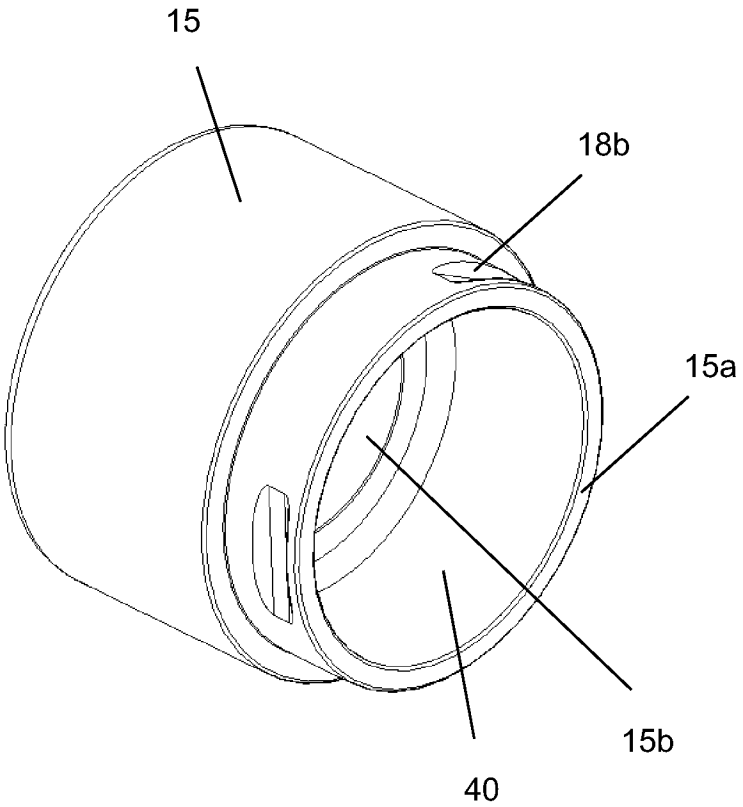
FIG. 11 illustrates a perspective view of the upper housing device.

The downwardly protruding ring 15*a* is also illustrated in FIG. 11, forming the compartment 40. As shown in FIG. 11, also the opening 15*b* for the mandrel device 10 is shown.

In similar way, the lower housing device 15 comprises an upwardly protruding ring 16*a*, having an inner diameter larger than the outer diameter of the lower protrusion 23 of the sleeve device 21. Hence, the protruding ring 16*a* forms a "cup", where the space inside the cup forms the lower part of the sleeve compartment 40.

In one or more embodiments, the upper and lower supporting devices 13, 14 are connected to the outer surface of the protruding rings 15*a*, 16*a* by means of connection devices 18, 19 respectively. The connection devices 18, 19 are causing the respective housing devices to be connected to their adjacent supporting devices. The connection devices are flexible connection devices allowing a limited axial movement between the supporting device and the housing device. In one or more embodiments, the connection device 18, 19 may be a flexible bolt connection in the form of a slotted tension pin, machined pins, dowel pins, hollow dowel pins, spring (slotted) dowel pins etc. inserted through an opening 18*a* of the supporting device 13 (indicated in FIG. 12) and into a groove 18*b* (indicated in FIG. 11) in the outer surface of the protruding ring 15*a*, where a small movement of the bolt 18*c* (FIG. 3) in the groove 18*b* is possible in the axial direction of the device 1.

Figure 12:
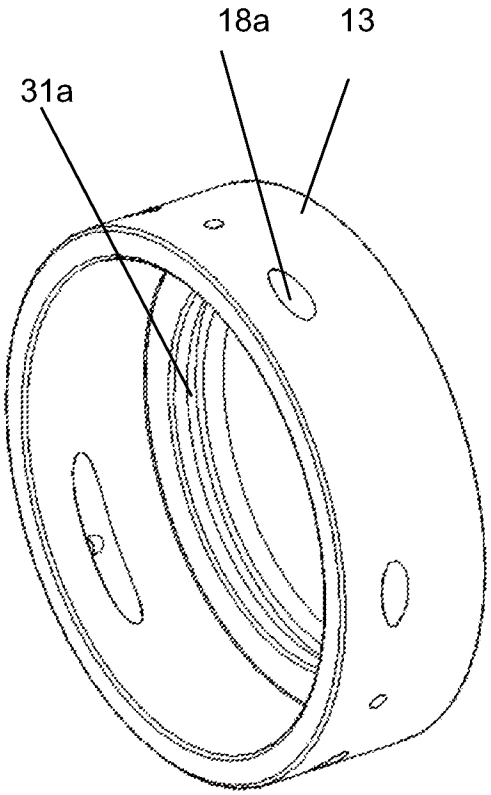
FIG. 12 illustrates a perspective view of the upper supporting device.

It should be noted that the upper housing device 15 shown in FIG. 11 is similar to the lower housing device 16, and that the upper supporting device 13 shown in FIG. 12 is similar to the lower supporting device 14.

It should be noted that the connection devices 18, 19 may comprise threaded connection devices allowing a limited axial movement between the respective supporting devices and housing devices, for example threaded connection devices where the threads are spaced apart to allow such movement. In FIG. 3, it is shown that the well tool device 1 further comprises an upper spring device 31 provided axially between the downwardly protruding ring 15*a* and the upper supporting device 13. As shown in FIG. 3, since the ring 15*a* has an inner diameter larger than the outer diameter of the upper protrusion 22 of the sleeve device 21, the upper spring device 31 is also provided axially between the upper protrusion 22 and the upper supporting device 13. Moreover, the upper spring device 31 is provided radially between the outer surface 24 of the sleeve device 21 and the upper supporting device 13. Hence, the spring device 31 will be axially compressed when the sleeve device 21 and the upper supporting device 13 moves towards each other due to the radial protrusion 22. The spring device 31 will also be compressed when the upper housing device 15 and the upper supporting device 13 moves towards each other.

In similar way, the well tool device 1 further comprises a lower spring device 32 provided axially between the upwardly protruding ring 16*a* and the lower supporting device 14. As shown in FIG. 3, since the ring 16*a* has an inner diameter larger than the outer diameter of the lower protrusion 23 of the sleeve device 21, the lower spring device 32 is also provided axially between the lower protrusion 23 and the lower supporting device 14. Moreover, the lower spring device 32 is provided radially between the outer surface 24 of the sleeve device 21 and the lower supporting device 22. Hence, the spring device 32 will be axially compressed when the sleeve device 21 and the lower supporting device 14 moves towards each other due to the radial protrusion 23 the lower spring device 32 will also be compressed when the lower housing device 16 and the lower supporting device 14 moves towards each other.

A compartment 31*a* for the upper spring device 31 is indicated radially inside the upper supporting device 13 in FIG. 12. A corresponding compartment for the lower spring device 32 will be present in the lower supporting device 14.

It should be noted that the cup springs 31, 32 in FIG. 3 are not fully compressed or are not compressed at all.

Figure 6:
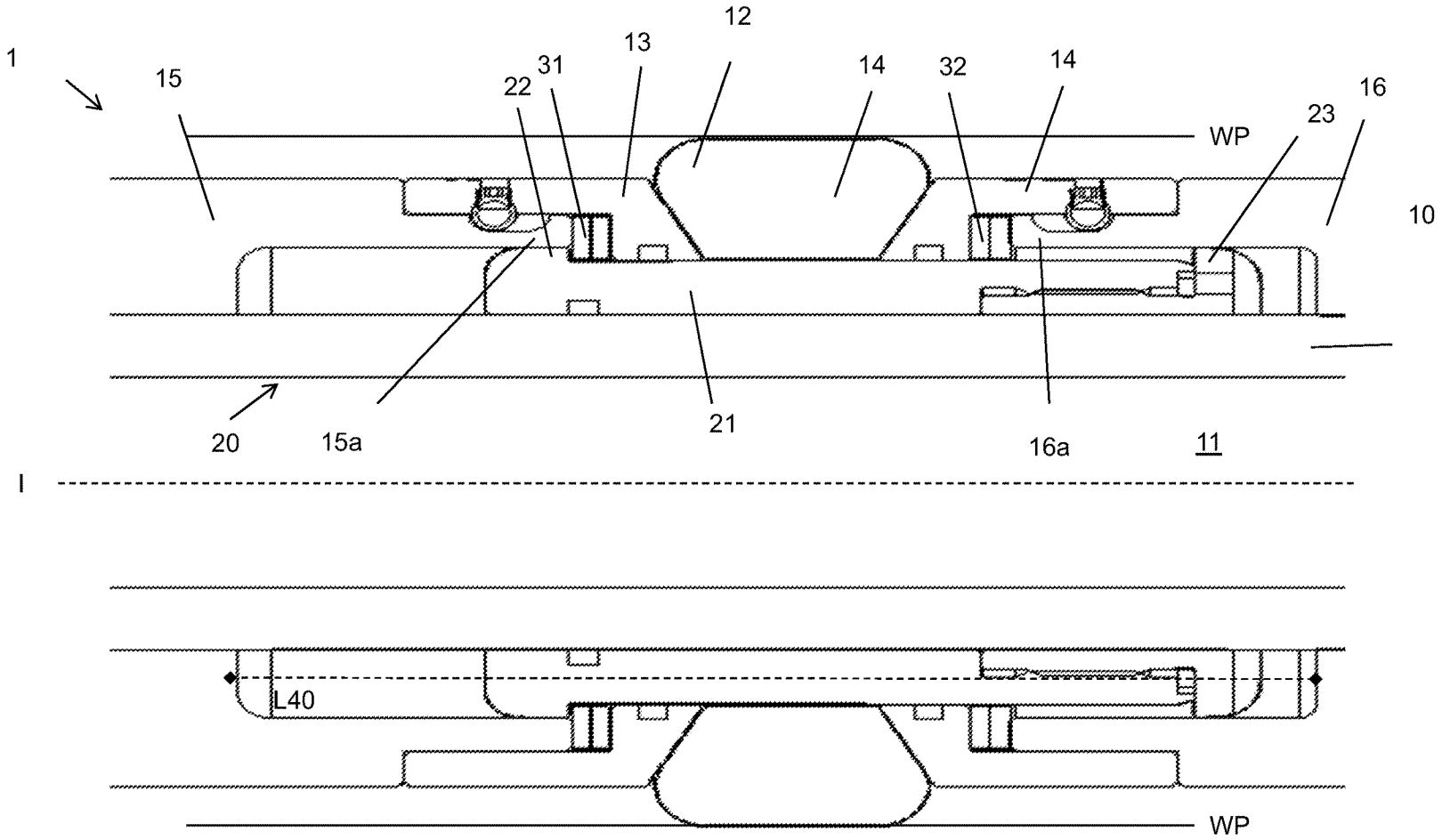
FIG. 6 illustrates a cross sectional view of one or more embodiments in the set state.

It is now referred to FIG. 6, where the well tool device 1 is in its set state. As shown, an axial movement between the upper and lower supporting devices 13, 14 has brought the sealing element 12 from its radially retracted state (the run state) to the radially expanded state (the set state). It is also shown that the outer surface of the sealing element 12 is in contact with the inner surface of the well pipe WP. Due to the above description of the connection between the supporting devices and their respective housing device, there has also been a relative axial movement between the housing devices towards each other in FIG. 6.

As shown, the sleeve compartment 40 has a length L40 in the set state that is shorter than the length L40 in the run state. In one or more embodiments, the length L40 of the sleeve compartment 40 in the set state is almost twice the length L21 of the sleeve device 21.

It should be noted that if the bore 11 is a through bore, fluid may flow inside the mandrel device 10. Such well tool devices are often referred to as packers. If the bore 11 is terminated, the well tool device is often referred to as bridge plugs. The well tool device 1 could also comprise an opening and/or closing mechanism provided in the bore 11, in order to allow the bore 11 to go from an open state to a closed state or to go from a closed state to an open state. The opening and/or closing mechanism can be a valve device, a fragile glass disc etc.

In FIG. 5 it is shown that the well tool device 1 comprises an obstruction device 50 comprising a frangible glass disc 51 which prevents fluid flow through the bore 11. A pin device 52 with a breaking mechanism is provided through an opening in the glass disc 51. If the pin device 52 is forced further through the glass disc, the breaking mechanism will cause the glass disc to bread and hence, fluid flow is allowed through the bore 11.

In FIG. 5 it is also shown that the well tool device 1 comprises a ratchet mechanism 60 comprising ratchet teeth 61 on the outer surface of the mandrel device 10 and a corresponding ratchet sleeve 62 fixed to the lower housing 16. As mentioned in the introduction above, the ratchet mechanism allows axial movement of at least one of the supporting device in one direction to move the sealing element from the run state to the set state, but prevents movement of the at least one supporting device in the opposite direction to prevent radial retraction of the sealing element.

Moreover, it should be noted that the well tool device 1 may be used in many different types of well tools, such as those mentioned in the introduction and in the above description. Hence, the well tool device 1 may comprise several components/elements not described in detail herein, such as anchoring devices for anchoring the tool to the inner surface of the well bore before the sealing element is brought to its set state, connection interfaces for setting tools, retrieval tools etc.

Some situations will now be described for the well tool device 1.

Figure 7:
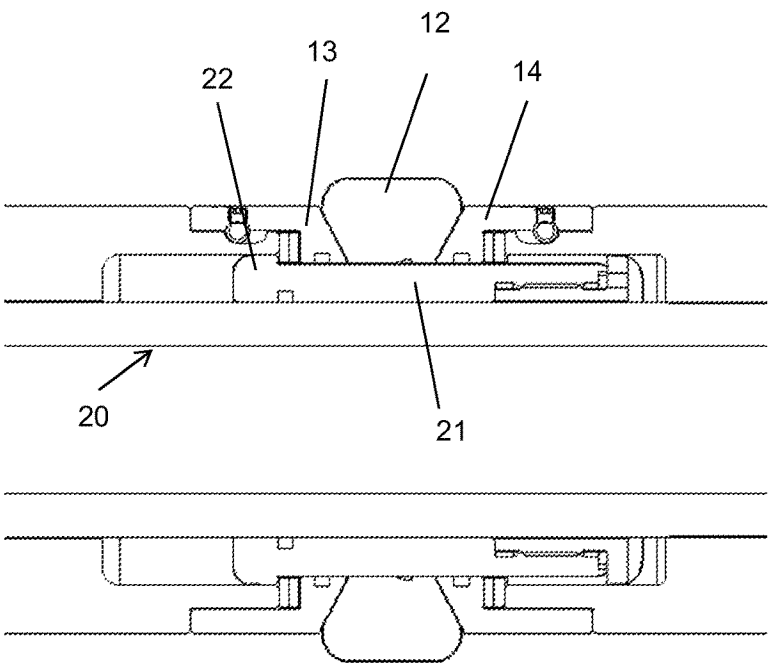
FIG. 7 illustrates a cross sectional view of one or more embodiments in which the sleeve device is in its lower end position.

In FIG. 7, which is similar to FIG. 6, the well tool device 1 has been set in a well pipe. After the setting operation, the well pressure becomes higher on the upper side of the sealing element 12 than on the lower side of the sealing element 12. If the pressure difference between the upper and lower side is sufficiently high, the sleeve device will move to the position shown in FIG. 7, and the upper protrusion 22 will apply a pressure to the upper supporting device 13, which will maintain the pressure from the upper supporting device 13 to the sealing element 12.

Figure 8:
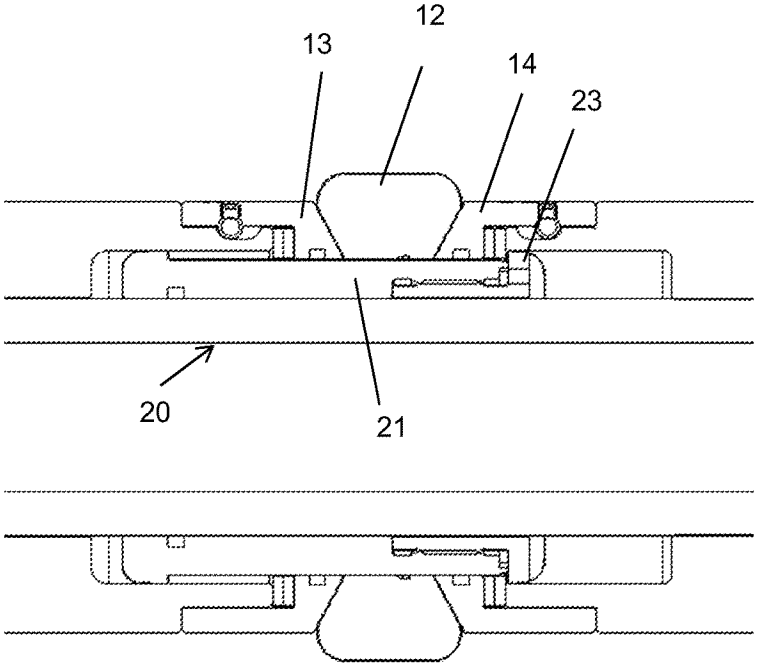
FIG. 8 illustrates a cross sectional view of the one or more embodiments in which the sleeve device is in its upper end position.

In FIG. 8, the pressure changes, and the pressure becomes higher on the lower side of the sealing element than on the upper side of the sealing element 12. The pressure difference will now cause the sleeve device 21 to move upwards from the position shown in FIG. 7 to the position shown in FIG. 8. The lower protrusion 23 will apply a pressure to the lower supporting device 14 and further to the sealing element 12. Hence, a pressure will be applied to the lower side of the sealing element 12, and the compression force from the supporting devices to the sealing element 12 is distributed more evenly again.

Figure 9:
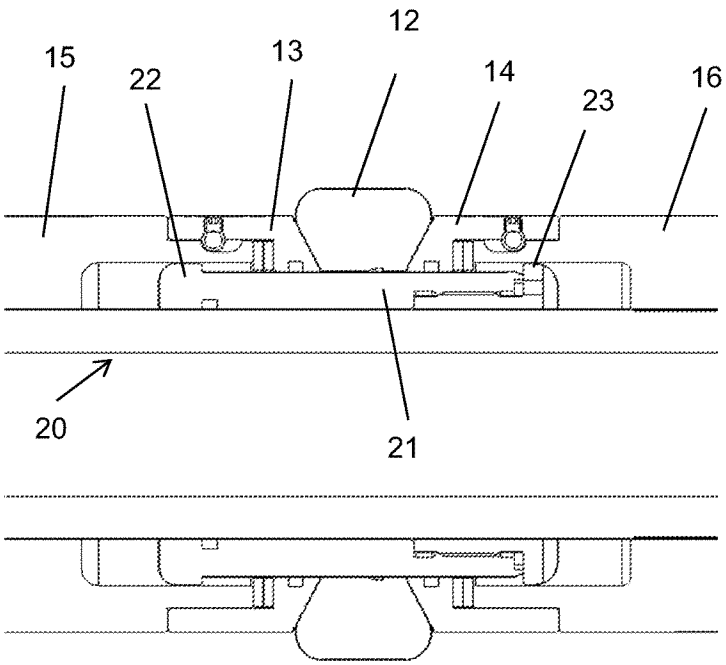
FIG. 9 illustrates a cross sectional view of one or more embodiments in which the sleeve device is in a central position, with the spring device in a first state.

In FIG. 9, the sleeve device 21 is in an intermediate position, i.e. a position between the positions shown in FIGS. 7 and 8. Here, the pressure on the lower side of the sealing element 12 is substantially equal to the pressure on the upper side of the sealing element 12.

Figure 10:
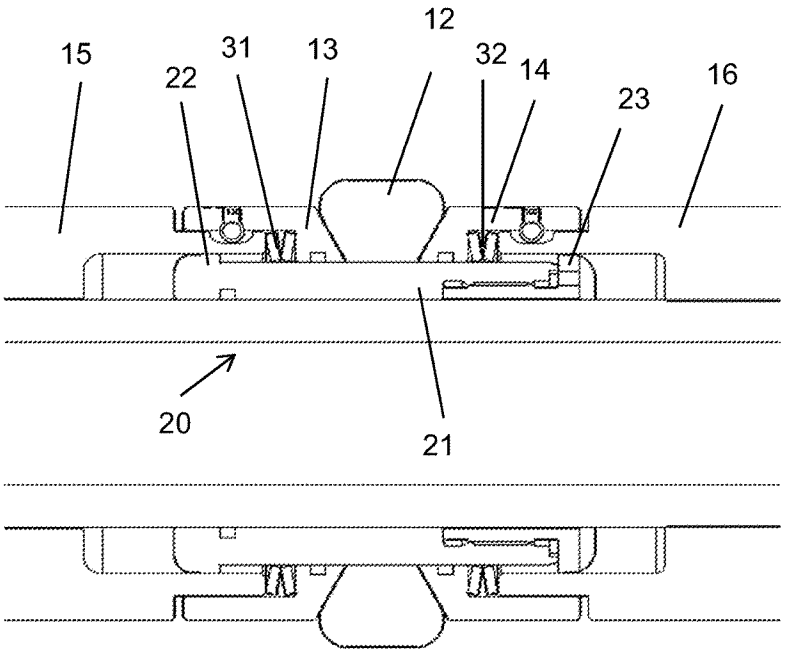
FIG. 10 illustrates a cross sectional view of one or more embodiments in which the sleeve device is in a central position, with the spring device in second state.

In FIG. 10, the sealing element 12 has become smaller than in FIG. 6, 7 or 8, for example due to a decline in temperature. It should be noted that the reduction in size is somewhat exaggerated in FIG. 10. Here, it is shown that the spring devices 31, 32 are less compressed than in FIG. 9, but that they still transfer a compression force from the respective upper and lower housing devices 15, 16 via the protruding devices 15*a*, 16*a* to the respective upper and lower supporting devices 13, 14.

In a similar way, the spring devices 31, 32 may prevent smaller undesired movement of the supporting devices 13, 14 such as the backlash movement of the ratchet mechanism described in the introduction.

According to the above, in "normal" situations, the axial compression forces applied from the upper and lower housing devices 15, 16 to the upper and lower supporting devices 13, 14 will provide a sufficient axial compression and hence a sufficient radial expansion of the sealing element 12. However, the sleeve device 21 will, via the upper protrusion 22, applying a downwardly directed axial force to the upper supporting device 14 when the sleeve device 21 is in its lower position. Moreover, the sleeve device 21 will, via the lower protrusion 23, apply an upwardly directed axial force to the lower supporting device 15 when the sleeve device 21 is in its upper position.

A prototype of one or more embodiments described above has been tested and found to fulfill the requirement of ISO14310 Grade V0, i.e. no gas leakage during 5 test periods of 15 minutes each. The temperature was cycled from 130° C. to 30° C. and back to 130° C. The pressure was cycled at 5000 psi from below, above and below at ambient temperature and farther from below at low temperature and last pressure cycle at high temperature from below.

The spring devices 31, 32 of the prototype each has a length of 6 mm in uncompressed state. Hence, the total length of the spring devices 31, 32 is 24 mm, considerably shorter than the spring devices of some prior art well tools having a length of 200-300 mm in the uncompressed state.

The total length of the prototype was approximately 86 cm, including the ratchet mechanism 60.

The connection devices 18, 19 of the prototype allows a relative movement between the respective housing devices and the respective supporting devices of ca 4 mm.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A well tool device, comprising:

a mandrel device;

a sealing element provided radially outside the mandrel device;

an upper supporting device provided outside of the mandrel device on an upper side of the sealing element;

a lower supporting device provided outside of the mandrel device on a lower side of the sealing element;

an upper housing device provided outside of the mandrel device on an upper side of the upper supporting device;

a lower housing device provided outside of the mandrel device on a lower side of the lower supporting device, wherein the well tool device may be configured between a run state, in which the sealing element is radially retracted, and a set state, in which the sealing element is radially expanded, wherein the well tool device further comprises a pressure distribution device for distributing the pressure on the sealing element in the set state via the upper and lower supporting devices, where the pressure distribution device comprises:

a sleeve device provided radially outside the mandrel device and radially inside the sealing element, where the sleeve device is axially displaceable in a sleeve compartment in relation to the mandrel device and the sealing element, wherein the sleeve device comprises an upper protrusion for applying a downwardly directed axial force to the upper supporting device when the sleeve device is in a lower position of a plurality of positions, wherein the sleeve device comprises a lower protrusion for applying an upwardly directed axial force to the lower supporting device when the sleeve device is in an upper position of a plurality of positions, wherein a first sealing device is provided radially between the inner surface of the sleeve device and an outer surface of the mandrel device, wherein the well tool device comprises at least one member of a group consisting of an upper spring device provided axially between the upper housing device and the upper supporting device and a lower spring device provided axially between the lower housing device and the lower supporting device, wherein the upper spring device is provided axially between the upper supporting device and the upper protrusion and, wherein the lower spring device is provided axially between the lower supporting device and the lower protrusion.

2. The well tool device according to claim 1, wherein the upper housing device is connected to the upper supporting device by an upper connection device, wherein the upper connection device allows a first axial displacement between the upper supporting device and the upper housing device.

3. The well tool device according to claim 1, wherein the upper housing device comprises a downwardly protruding ring forming the sleeve compartment, wherein the downwardly protruding ring has an inner diameter larger than an outer diameter of the upper protrusion of the sleeve device.

4. The well tool device according to claim 1, wherein the lower housing device is connected to the lower supporting device by a lower connection device, wherein the lower connection device allows a second axial displacement between the lower supporting device and the lower housing device.

5. The well tool device according to claim 1, wherein the lower housing device comprises a upwardly protruding ring forming the sleeve compartment, wherein the upwardly protruding ring has an inner diameter larger than an outer diameter of the lower protrusion of the sleeve device.

6. The well tool device according to claim 1, wherein the upper and lower protrusions are protruding in a radial direction out from the sleeve device.

7. The well tool device according to claim 1, wherein a second sealing device is provided radially between the upper supporting device and the sliding surface.

8. The well tool device according to claim 1, wherein a third sealing device is provided radially between the lower supporting device and the sliding surface.

9. The well tool device according to claim 1, wherein the well tool is a plugging device, a bridge plug, a packer, a straddle, or a production packer.

* * * * *